US005359779A

United States Patent [19]

Polk et al.

[11] Patent Number: 5,359,779

[45] Date of Patent: Nov. 1, 1994

[54] ILLUMINATION AND LASER SIGHTING DEVICE FOR A WEAPON

[76] Inventors: Richard N. Polk, P.O. Box 9802, No. 833, Austin, Tex. 78766; Thomas A. Pertierra, 1005 Romano Ave., Orlando, Fla. 32807

[21] Appl. No.: 958,869

[22] Filed: Oct. 8, 1992

[51] Int. Cl.[5] ..... F41G 1/36; F41G 1/35

[52] U.S. Cl. ..... 33/241; 33/DIG. 21; 42/103; 362/184

[58] Field of Search ..... 33/241, 233, 263, DIG. 21; 362/184, 227, 228, 230, 231, 234, 253, 259; 42/103

[56] References Cited

U.S. PATENT DOCUMENTS

| | | | |
|---|---|---|---|
| 1,946,059 | 2/1934 | Buchholz | 362/184 |
| 2,128,526 | 8/1938 | Eslick | 33/241 |
| 2,597,565 | 5/1952 | Chandler et al. | 33/241 |
| 4,212,109 | 7/1980 | Snyder | 33/241 |
| 4,939,863 | 7/1990 | Alexander et al. | 33/DIG. 21 |
| 5,064,988 | 11/1991 | E'nama et al. | 42/103 |

*Primary Examiner*—Christopher W. Fulton
*Attorney, Agent, or Firm*—Kevin L. Daffer

[57] ABSTRACT

A low-profile illumination and laser sighting device is provided for sighting a weapon. The illumination and laser sighting device of the present invention includes a single compartment housing and a receptacle placed at one end of the housing. At least one laser is fixed to a support member adjustably coupled to the receptacle and an illumination lamp is coupled to the receptacle in an offset position over the laser. The illumination lamp includes an aperture placed through a reflector wall to allow passage of a laser beam or beams from the laser or from more than one laser. Accordingly, the laser beams and illumination from the lamp pass through a single lens at the forward end of the device. The lasers as well as illumination lamp are thereby self-contained within a single housing and can be easily sealed against outside gas, liquid or solid material. Adjustment mechanism remains primarily inside the device and thereby protected against the outside environment or objects striking the mechanism.

16 Claims, 3 Drawing Sheets

ILLUMINATION AND LASER SIGHTING DEVICE FOR A WEAPON

BACKGROUND OF THE INVENTION

1. Field of the Invention

This invention relates to an attachment for sighting a weapon and more particularly to a low-profile illumination and laser sighting attachment having a single lens for receiving emission from both an illumination lamp and at least one aiming laser.

2. Background of the Relevant Art

Devices used for sighting or aiming a weapon, such as a firearm, are well known. Conventional aiming devices often involved a protrusion placed on the external surface of the firearm's barrel. Other aiming devices utilize magnifying scopes for more accurate placement of the firearm's output. These conventional sights generally require the user to view the target through the sight. Therefore, the weapon must be brought to eye level and within the line of sight of the user in order to be an effective aiming or sighting tool.

With the advent of the laser, it no longer is necessary that the weapon be fired at eye level but instead can be fired from, e.g., the hip. The laser therefore became a point of aim, point of impact sighting device. Wherever the laser impinges on the target is where the output of the weapon will strike. Thus, zeroing in on the target using a laser is accomplished much faster than conventional, non-laser methods.

An early laser aiming device is described in U.S. Pat. No. 4,212,109 to Snyder. Patent '109 describes the difficulty often encountered with adjusting or calibrating the placement of the lasers at the point of impact. Windage and elevation screws are shown placed on a bracket used to hold the laser housing to the weapon. By adjusting the position of the bracket with respect to the weapon, the laser output position is thereby moved to proper calibration. Unfortunately, since the bracket is exposed, there remains a possibility that the bracket as well as the adjustment screws can become jarred or caught on surrounding objects thereby inadvertently moving the laser sights out of calibration. Thus, there is a need for a laser aiming device which has its calibration mechanism protected from external objects to ensure reliable, long-term calibration.

A more recent laser aiming device is described in U.S. Pat. No. 5,064,988. Patent '988 not only uses a laser to aim the firearm, but also uses an illumination lamp to help illuminate the general target area. The lamp is therefore particularly suited for nighttime use for lighting the target area and targeting the laser beam on the lighted area. Moreover, the lamp can be covered with an infrared filter to prevent a live target from ascertaining the whereabouts of the weapon user. An infrared illumination combined with an infrared laser thereby achieves complete covert nighttime operation necessary in many military and law enforcement operations.

While the combination illumination and laser sighting device provides more flexibility for the user, conventional sighting devices are often large and bulky. Conventional combination devices such as that shown in Patent '988 require a rather large housing having two or more compartments. One compartment is used to house the lasers and the other compartment is used to house a battery pack. The battery pack is needed to power the illumination lamp while a separate battery pack operating at a different voltage is often required to power the lasers. Two separate compartments and two separate battery packs adds a considerable amount of size and weight to the combination device. Moreover, separate compartments with separate batteries operating at different output voltages increases considerably the cost in manufacture and operation of the device.

An additional problem associated with many conventional illumination and laser sighting devices is that the laser beam origination point is completely separate from the illumination path origination point. For example, as shown in Patent '988, a laser beam originates at a point above and completely outside the lamp source area. In order to maintain the lasers and lamp area dust-free and watertight, two separate lenses are needed—one lens for covering the lasers and the other lens for covering the illumination lamp. Not only does two separate lenses add to the cost of manufacture, but in addition, two separate lenses requires two separate infrared filters placed over each lens if complete nighttime operation is desired. One filter placed over the lamp ensures only infrared illumination while the other filter placed over the lasers ensures that the non-infrared laser does not emit detectable energy. To avoid using a filter over the lasers, an electrical switch can be added to selectively activate one laser as opposed to the other. However, the addition of the extra switch may only further increase the cost and size of the device.

SUMMARY OF THE INVENTION

The problems outlined above are in large part solved by the device of the present invention. That is, the illumination and laser sighting device hereof provides a low-profile housing package having only a single compartment. The single compartment houses a single battery pack which powers one or more lasers and the illumination lamp. By needing only a single compartment, the present device is more compact and thereby is less likely to become snagged or jarred on surrounding objects. Further, the compact, low-profile device can be more easily used on a broader variety of weapons, including small caliber firearms or handguns where lightweight and compactness is essential for operation.

The low-profile design hereof makes available other attributes as well. A single lens covering both the lasers and illumination lamp provides a simpler design necessary for a more reliable operation. By ensuring the integrity of a single sealed filter lens as opposed to two or more lenses, the present device poses a greater chance of remaining watertight and dustproof. As a corollary thereto, only a single filter is needed to cover the lens in order to make the entire device operate in a selected radiation spectrum such as infrared, etc. Still further, calibrating one or more lasers of the present device is easily achieved by adjustment screws placed in a protected position posterior to the laser housing. Even still further, the entire laser calibration mechanism of the present device is protected within a lamp housing and sealed from the outside elements.

Broadly speaking, the present invention contemplates a low-profile illumination and laser sighting device comprising a housing surrounding a single compartment and having a receptacle at one end of the compartment. One or more lasers are fixed to a support member adjustably coupled to the outside surface of the receptacle. The support member includes a first support adjustment screw received at one location within the support member, a second support adjustment screw is received at another location within the support member, and a center pivot member is received within the support member between the first and second adjustment screws. The support member and attached lasers thereby move about the pivot member during rotational movement of the first and second adjustment screws. An illumination lamp is coupled to the receptacle in an offset position over the lasers, and one or more momentary pressure switches are mounted on the outside of the housing for selectively controlling the lasers and the illumination lamp.

The present invention also contemplates an illumination and laser sighting device comprising a housing having a receptacle at one end of the housing and one or more lasers adjustably coupled to the receptacle. An illumination lamp is coupled to the receptacle in offset position over the lasers. The lamp includes a reflector and an aperture placed through the reflector whereby the aperture is alignable over the lasers for receiving passage of an emission from the lasers. The lamp includes a reflector housing having openings at opposite ends of the reflector housing with one end adapted for being threaded to the receptacle. The lamp also includes a clear optical lens cap assembly threaded over the other end of the reflector housing, whereby the reflector is secured between the lens and the reflector housing. The reflector includes an arcuate reflecting wall radially diverging from a central axis and an aperture placed through the reflecting wall offset from the central axis.

The present invention further contemplates an illumination and laser sighting device for a weapon comprising a cylindrical housing having a longitudinal axis and a cross-sectional circular circumference, the housing is adapted for attachment to a weapon. A circular receptacle is attached at one end of the cylindrical housing, the receptacle includes a larger circumference than the cross-sectional circular circumference of the housing. Moreover, the receptacle has a central axis offset from the longitudinal axis of the cylindrical axis. A single power supply is coupled within the housing and one or more lasers are fixed to a support member adjustably coupled to the outside surface of the receptacle. If two or more lasers are suitably used, at least one laser may emit visible light while another laser may emit light outside the visible spectrum detectable by the naked eye. An illumination lamp is coupled to the receptacle, the lamp having a reflector and an aperture placed through the reflector. A pressure switch is mounted on the outside of the housing for selectively controlling the lasers and the illumination lamp, and electrical conductors are connected between the single power supply and the pressure switch. A function switch may be mounted on the weapon for selectively coupling the power supply to the pressure switch, for coupling the power supply to the lamp and laser, or for uncoupling the power supply from the lamp and laser.

BRIEF DESCRIPTION OF THE DRAWINGS

Other objects and advantages of the invention will become apparent upon reading the following detailed description and upon reference to accompanying drawings in which.

Figures 1, 2:
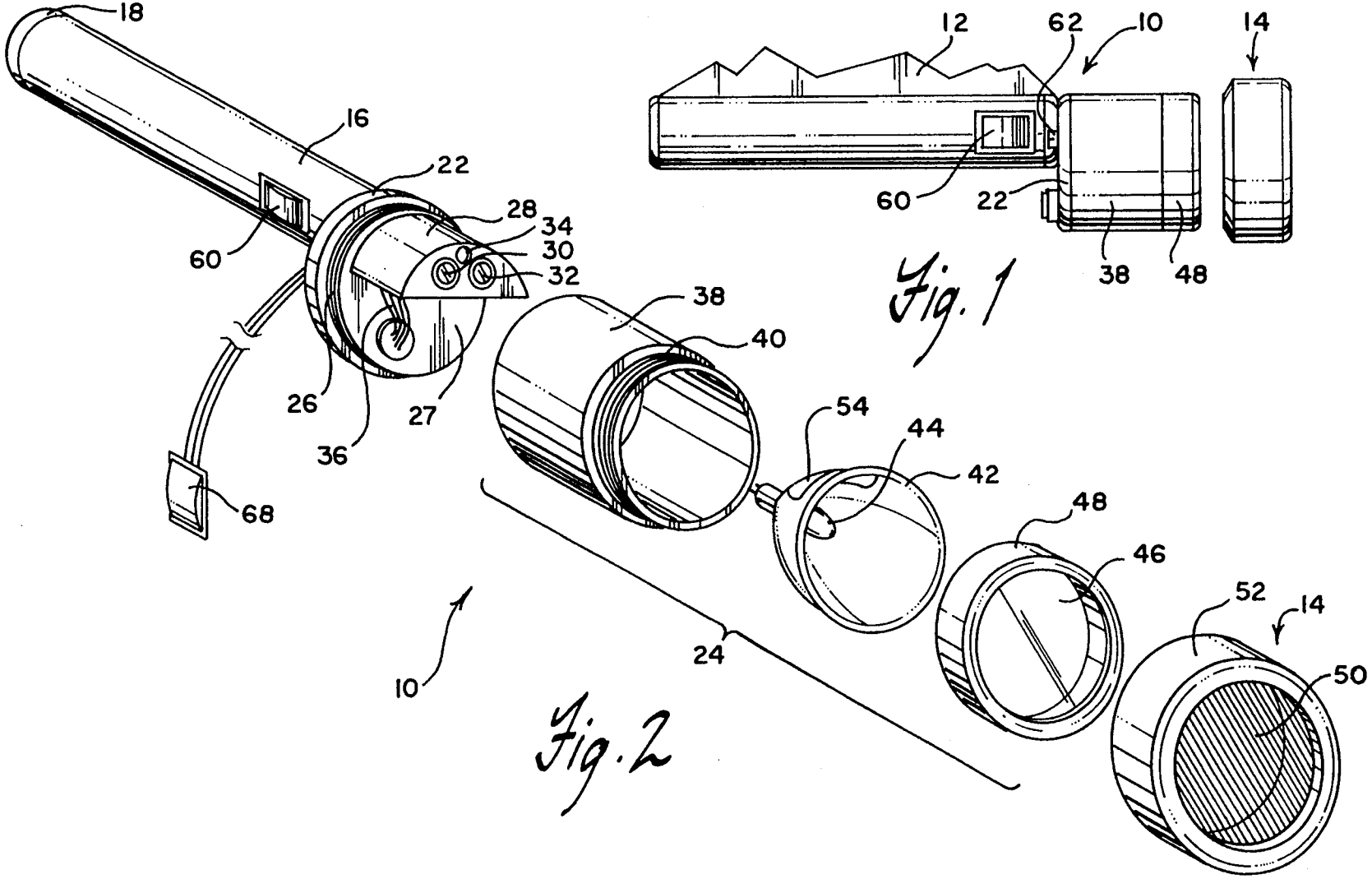
FIG. 1 is an elevational view of an illumination and laser sighting device according to the present invention mounted on a weapon.
FIG. 2 is a partially exploded view of an illumination and laser sighting device according to the present invention.

While the invention is susceptible to various modification and alternative forms, a specific embodiment thereof has been shown by way of example in the drawings and will herein be described in detail. It should be understood, however, that the drawings and description thereto are not intended to limit the invention to the particular form disclosed, but on the contrary, the intention is to cover all modifications, equivalents and alternatives falling with the spirit and scope of the invention as defined by the appended claims.

DETAILED DESCRIPTION OF THE INVENTION

Turning now to the drawings, FIG. 1 illustrates an elevation view of an illumination and laser sighting device 10 coupled to a weapon 12. Device 10 can be connected to weapon 12 by any conventional technique known in the art. Weapon 12 is generally described as any device capable of expelling output of either mass or energy to a target location. Thus, weapon 12 includes but is not limited to a firearm, an electromagnetic railgun or a laser.

Placeable over one end of device 10 is an electromagnetic radiation filter 14 which blocks or interrupts emission of certain radiation wavelengths while allowing emission of other wavelengths. A suitable filter 14 includes an infrared (IR) filter. Filter 14 can be either an active or passive filter of well known type. For example, a suitable IR passive filter utilizes a pre-manufactured germanium lens.

Referring to FIG. 2, device 10 is shown in a partial exploded view. Device 10 includes a housing 16 which can be made of any suitable material with black anodized aluminum being particularly suitable. Housing 16 may be made of any shape or size and is shown in FIG. 2 to be cylindrical with an end cap 18 at one end of the cylindrical housing. End cap 18 can be removed to allow access to a power supply 20 (shown in FIG. 5) placeable within housing 16. Power supply 20 is chosen to output a single voltage to device 10 during operation. By using a single power supply having a single output voltage, housing 16 requires only one compartment to contain the single power supply 20 as opposed to the multiple compartments found in many prior art designs. Multiple compartments are certainly not needed nor are they desired in this low-profile, lightweight design of the present invention.

Coupled at one end of housing 16 is a receptacle 22. Receptacle 22 may be of larger diameter than the cross-sectional diameter of housing 16 and is preferably configured to allow quick attachment of an illumination lamp 24 of larger cross-sectional diameter than housing 16. Coupling between receptacle 22 and lamp assembly 24 can be achieved in any suitable fashion with matching threads being a preferred design. Placed near the perimeter of receptacle 22 are threads 26 which match to and are coupled onto matching threads (not shown) on lamp assembly 24. Placed on outside surface 27 of receptacle 22 and radially inside of threads 26 is a support member 28. Support member 28 is made of a suitable lightweight material (such as polycarbonate or aluminum) which is adjustably coupled to outside surface 27. Fixed within support member 28 is at least one laser. If two lasers are chosen as the preferred design alternative, then they are shown as reference numerals 30 and 32. Support member 28 and lasers 30 and 32 are adjustably connected to surface 27 by a pivot member 34 which will be described in more detail later. Electrical energy is carried to a single laser, a pair of lasers (i.e., 30 and 32), or multiple lasers, from power supply 20 via conductors 36 as shown.

Illumination lamp assembly 24 includes a reflector housing 38 having openings at opposite ends of the reflector housing and a coupling mechanism such as threads 40 placed at the perimeter of each end of the housing. A reflector 42 which includes a reflective radially diverging reflecting wall is used to forward direct radiation from bulb 44 as known in the art. Reflector 42 can be manufactured of any suitable reflective material of well known type. A lens 46 is secured over the outer flange of reflector 42 onto reflector housing 38 by a lens attachment member 48. The inside diameter of member 48 may include threads which match threads 40 on the outer diameter of reflector housing 38 to allow quick and easy attachment thereto. Lens 46 can be manufactured using any suitable break-resistant material such as a transparent polycarbonate material similar to LEXAN®.

Attachable over lens attachment member 48 is an active or passive electromagnetic radiation filter 14 which is pre-manufactured or operably activated to filter specific wavelengths of radiation emitted from bulb 44 and lasers 30 and 32. A suitable filter is one which only allows the emission of IR wavelengths which lie above the 700 nm range. A pre-manufactured germanium lens provides passive IR filtration and is a suitable design; however, active lenses which receive electrical stimuli can also be chosen which selectively filter various emission wavelengths depending upon the magnitude of applied stimuli. A filter housing 52 contains filter lens 50 and is utilized to allow rapid placement of lens 50 over member 48. Filter housing 52 can be made of any flexible material with vinyl or rubber being particularly suitable. Housing 52 thereby flexes as it is placed over 50 and remains firmly connected thereto after placement. Filter 14 can be easily removed by simply re-flexing and pulling housing 52 from member 48. Filter housing 52 may also be manufactured out of a rigid material (such as aluminum) and machined to allow placement and removal through the use of thumbscrew-type retaining fasteners (not shown) that engage the exterior of member 48.

Each element of housing 16, cap 18, receptacle 22, housing 38 and member 48 are made of watertight and dustproof material. Further, attachment between each element is also made watertight and dustproof using seals (not shown) placeable between each element to allow underwater operation or operation in dusty or high humidity environments.

A particularly suitable aspect of the present invention is aperture 54 placed through the side wall of reflector 42. Aperture 54 is preferably aligned over lasers 30 and 32 to allow passage of emitted wavelengths from the lasers through reflector 42 and lens 46. Aperture 54 is placed through the reflective wall in an offset position from the central axis location (i.e., bulb 44 location) of reflector 42. By utilizing reflector 42 for directing the emission from bulb 44 and lasers 30 and 32, a single lens 46 can be used to cover and seal the entire internal mechanism against outside liquid, gas and solid particulate matter. Moreover, since housing 16 includes a single compartment as opposed to two or more compartments, the relative placement of laser and lamp emission is parallel and within close proximity of each other to allow operation through a single lens. Still further, one laser (e.g., laser 30) can be made to emit a specific non-visible radiation wavelength (i.e., radiation which is not visible to the naked eye) such as IR, while the other laser (e.g., laser 32) can emit visible radiation wavelengths. Using, for example, two constant-on lasers (one which emits visible wavelengths and the other which emits non-visible wavelengths) allows filter 14 to select which laser will be emitted depending upon whether filter 14 is attached or is not attached. Thus, both lasers 30 and 32 are preferably on at the same time with selection of the suitable laser provided through either attaching filter 14 or not attaching filter 14. If, for example, filter 14 is not attached, then only the visible laser will be detected with the naked eye. However, if filter 14 is attached then only the IR laser will be detected using night vision goggles. By applying the filter as the switching mechanism for the lasers, an additional electrical switching circuit and external switch is not needed for selecting the desired lasers. The addition of an electrical switching mechanism will undesirably add to the cost of manufacture of device 10 as well as adding weight and complexity to the overall design.

Since filter 14 is generally used to select either visible illumination or non-visible illumination, the use of filter 14 is thereby advantageously used to simultaneously select which laser will be emitted. For example, during night vision, filter 14 can be placed over a single lens 46 to select an IR laser and the IR spectrum of light from bulb 44. Simultaneously, the visible laser is de-selected and all visible emission from lamp bulb 44 is prevented from being emitted from device 10. Therefore, placement of a single filter over a single lens provides night vision whereas removal of the filter 14 provides day vision. Both the illumination lamp and lasers need not be internally selected, instead they can be easily selected by merely adding or removing the external filter 14.

Figure 3:
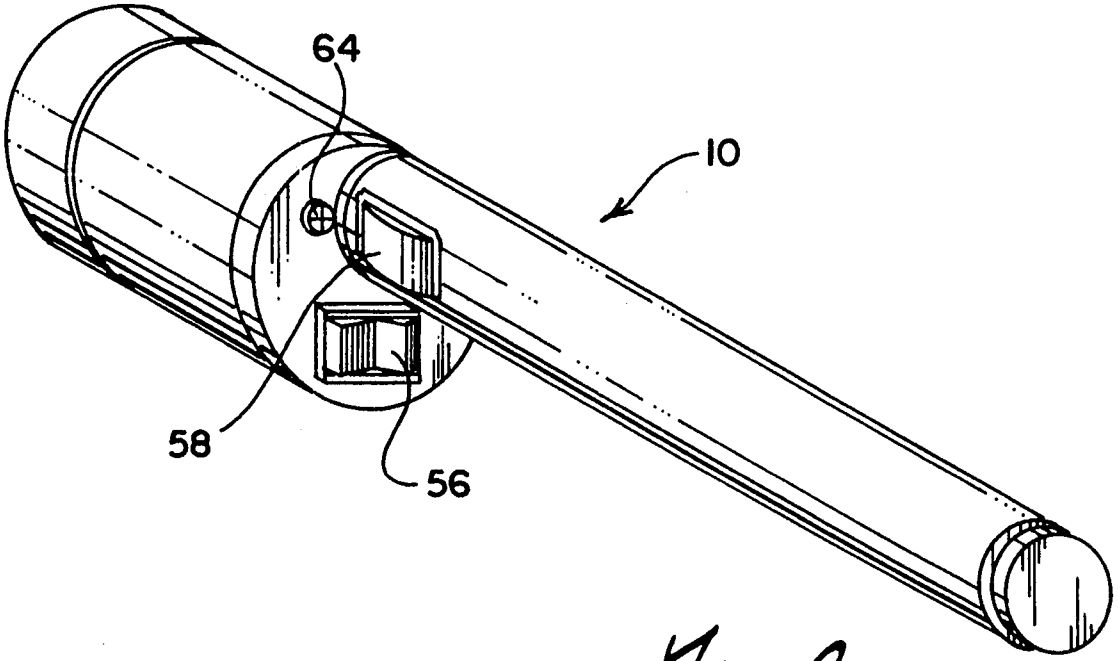
FIG. 3 is a reverse isometric view of an illumination and laser sighting device according to the present invention.
Figure 5:
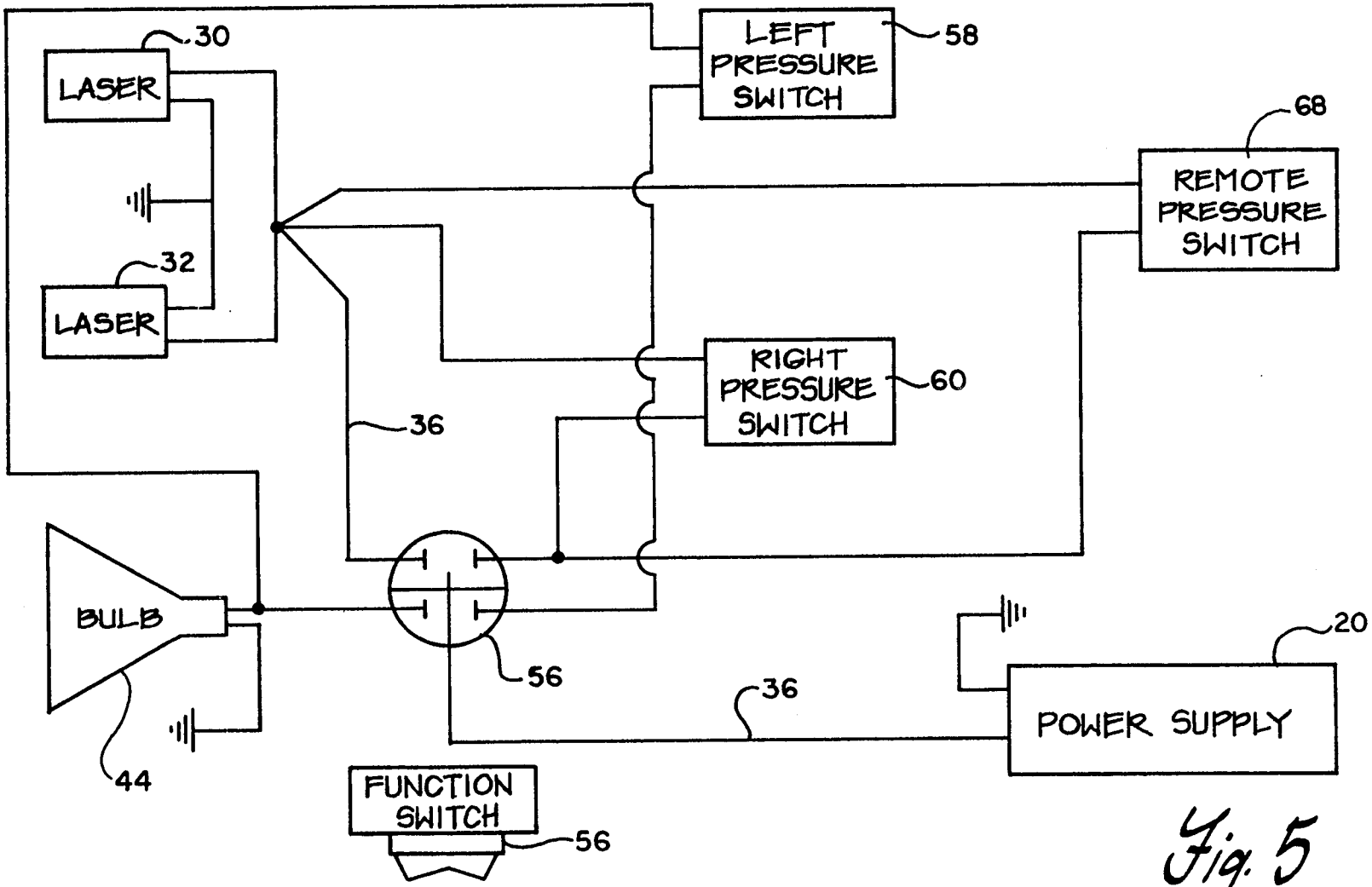
FIG. 5 is a circuit block diagram of the power supply and switching mechanism according to the present invention.

Referring to FIG. 3, a reverse isometric view of device 10 is shown detailing a function switch 56 placed on the posterior surface of receptacle 22. Function switch 56 serves to selectively activate lamp bulb 44 and lasers 30 and 32. For example, switch 56 may be a double pole triple throw switch which has three operable positions. One position may allow bulb 44, laser 30 and laser 32 to be constantly on. Another position may ensure that bulb 44 and lasers 30 and 32 remain off. A third position may selectively activate lasers 30 and 32 and bulb 44 through left pressure switch 58 (shown in FIG. 3) and right pressure switch 60 (shown in FIGS. 1 and 2). The constant on, constant off, or momentarily selected positions of switch 56 are but a few examples of the various ways in which switch 56 can be connected between power supply 20, laser 30, laser 32 and bulb 44. Various other wiring schemes can be used depending upon the particular application desired. Moreover, switch 56 can be omitted if desired to simply allow pressure switches 58 and 60 to perform all necessary switching operations. A more detailed description of one suitable switching operation is shown in FIG. 5 and will be described below.

Figure 4:
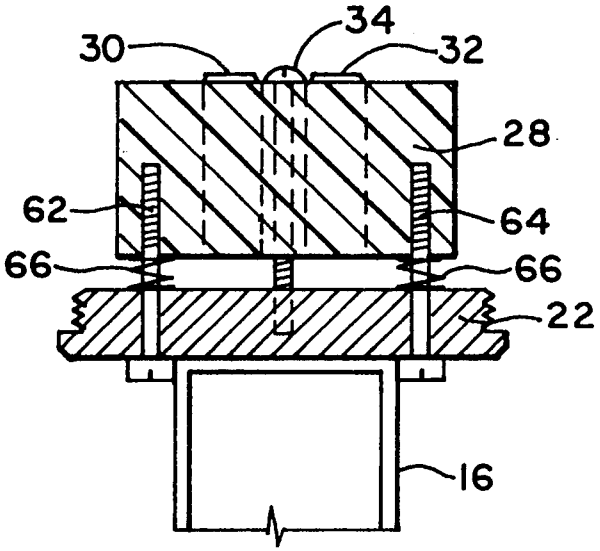
FIG. 4 is a detailed cross-sectional view of a laser support member and associated adjustment mechanism according to the present invention.

Referring to FIG. 4, a detailed cross-sectional view of support member 28 is shown adjustably coupled to or near the outside surface of receptacle 22. In particular, a pair of support adjustment screws 62 and 64 are placed into support member 28, wherein each screw includes threads placed at or near the distal end and a head placed at the proximal end. Rotation of the head causes the corresponding screw 62 or 64 to embed deeper within support member 28. Conversely, rearward rotation of the head causes retraction of the corresponding screw 62 or 64 from support member 28. A biasing member, such as a coiled spring, is placed over both the first and the second adjustment screws 62 and 64, respectively, and is positioned between receptacle 22 and support member 28 to bias the position of member 28 relative to receptacle 22.

As further shown in FIG. 4, a center pivot member 34 is received within support member 28 and receptacle 22. Pivot member 34 is adapted to allow relative pivot of support member 28 about member 34 or pivot of member 34 about receptacle 22. Pivot member 34 is thereby stationed to provide a focal point about which support member 28 can pivot in response to tightening or loosening of screws 62 or 64.

Pivot member 34 is preferably placed between lasers 30 and 32 and slightly above a horizontal line connecting the cross-sectional centers of each laser as shown in FIG. 2. First and second adjustment screws 62 and 64, respectively, are placed equidistant from center pivot member 34 as shown in FIG. 4. A tightening of first adjustment screw 62 will move both lasers causing the point of laser impingement to move in a diagonal plane upon the target. Alternatively, tightening of second adjustment screw 64 will also move both lasers in a diagonal plane perpendicular to the diagonal movement caused by tightening or loosening of first screw 62. Thus, tightening or loosening of an adjustment screw of the present device causes diagonal movement of the sighting beam upon the target as opposed to the horizontal or vertical windage and elevation movement of prior devices. For example, a vertical adjustment requires tightening or loosening of both screws 62 and 64.

Referring to FIG. 5, a circuit block diagram of one embodiment of the power supply and switching mechanism is shown. There are numerous methods by which power can be selectively applied to laser 30, laser 32 and lamp bulb 44. FIG. 5 shows but one method of selectively activating the present invention. The conductors 36 utilized for making connections between power source 20 and lasers/illumination lamp are preferably contained within housing 16 between power supply 20 and support member 28. Various other conductors can be connected between function switch 56, laser 30, laser 32 and bulb 44.

Using FIG. 5 circuit schematic merely as an example, power supply 20 is connected to a central pole of a double pole, triple throw switch 56 known in the art. Activating one side of the switch causes power supply 20 to be connected directly to lasers 30 and 32 as well as lamp bulb 44. Activating switch 56 in a center position may cause power supply 20 to be disconnected from any remaining portions of the schematic and thereby prevent its discharge. Placing the switch in a right position may route power supply 20 to left and right pressure switches 58 and 60, respectively. If, for example, switch 58 is activated, then bulb 44 will turn on provided function switch 56 connects power supply 20 to switches 58 and 60. Alternatively, if pressure switch 60 is activated, then lasers 30 and 32 will turn on provided switch connects power supply 20 to switches 58 and 60.

Using the exemplary switching scheme shown in FIG. 5, illumination lamp assembly 24 and lasers 30 and 32 can be selected continuously on, continuously off or momentarily on (depending upon whether switches 58 and/or 60 are activated). If switch 58 is activated but not switch 60, then only lamp bulb 44 will turn on. Conversely, if switch 60 is on but switch 58 is off, then lasers 30 and 32 will appear on. If both switches 58 and 60 are activated, then lamp bulb 44 as well as lasers 30 and 32 will appear on. Switches 58 and 60 may be interchanged to accommodate the operator.

As further shown in FIGS. 2 and 5, a remote pressure switch 68 can be used to selectively activate lasers 30 and 32. Remote switch 68 can be mounted anywhere upon the weapon and preferably near the pistol grip of the weapon. Only during activation of remote switch 68 will visible or non-visible lasers appear upon the target thereby providing additional covert and non-detectable target acquisition. Remote pressure switch 68 allows the operator one handed operation of selected functions of the laser aiming lighting projector system (LALPS) of the present invention by placing the remote switch on the weapon's pistol grip which frees up the other hand for other actions.

It will be appreciated to those skilled in the art having the benefit of this disclosure that this invention is believed to be capable of applications with numerous types of weapons embodying the same. It is also to be understood that the form of the invention shown and described is to be taken as a presently preferred embodiment. Various modifications and changes may be made without departing from the spirit and scope of the invention as set forth in the claims. An exemplary modification might be using a single selectable laser rather than a pair of lasers or a plurality of selectable lasers. Another modification might be a miniaturized device which can be placed on a small handgun or the like. It is intended that the following claims be interpreted to embrace all such modifications and changes.

What is claimed is:

1. A low-profile illumination and laser sighting device comprising:

a housing surrounding a single compartment and having a receptacle at one end of said compartment;

at least one laser fixed to a support member adjustably coupled to the outside surface of said receptacle, wherein said support member comprises:

a first support adjustment screw adjustably received at one location within said support member;

a second support adjustment screw adjustably received at another location within said support member;

a center pivot member partially received within said support member between said first and second adjustment screws, whereby said support member and attached lasers move about said pivot member during rotational movement of said first and second adjustment screws;

an illumination lamp coupled to said receptacle in an offset position over said laser; and pressure means mounted on the outside of said housing for selectively controlling said laser and said illumination ramp.

2. The illumination and laser sighting device as recited in claim 1, wherein said first and second adjustment screws further comprise a coiled spring placed over each said adjustment screw and between said receptacle and support member.

3. A low-profile illumination laser sighting device comprising:

a housing surrounding a single compartment and having a receptacle at one end of said compartment;

at least one laser fixed to a support member adjustably coupled to the outside surface of said receptacle;

an illumination lamp coupled to said receptacle in an off-set position over said laser, wherein said lamp comprises:

a reflector housing having openings at opposite ends of said reflector housing;

a lens adapted for being coupled over one end of said reflector housing;

a reflector secured between said lens and said reflector housing, said reflector having an arcuate wall and an aperture placed through said wall; and pressure switch means mounted on the outside of said housing for selectively controlling said laser and said illumination lamp.

4. An illumination and laser sighting device comprising:

a housing having a receptacle at one end of said housing;

at least one laser adjustably coupled to said receptacle;

an illumination lamp coupled to said receptacle in offset position over said laser, said lamp including a reflector and an aperture placed through said reflector whereby said aperture is alignable for receiving passage of an emission from said laser; and a single power supply placed within said housing and selectively connected to said laser and said illumination lamp.

5. The illumination and laser sighting device as recited in claim 4, wherein said housing is cylindrical having a central longitudinal axis.

6. The illumination and laser sighting device as recited in claim 5, wherein said receptacle is substantially circular having a central axis substantially parallel and offset from the central longitudinal axis of said housing.

7. The illumination and laser sighting device as recited in claim 4, wherein said lamp comprises:

a reflector housing having openings at opposite ends of said reflector housing, said one end adapted for being threaded to said receptacle;

a lens adapted for being threaded over said other end of said reflector housing;

said reflector secured between said lens and said reflector housing, said reflector having an arcuate reflecting wall radially diverging from a central axis; and said aperture placed through said reflecting wall offset from said central axis.

8. The illumination and laser sighting device as recited in claim 7, wherein said lens is adapted to receive passage of an emission from said lamp and at least one said laser.

9. The illumination and laser sighting device as recited in claim 7, wherein one of said lasers emits light visible to the naked eye and the other of said lasers emits light non-visible to the naked eye.

10. The illumination and laser sighting device as recited in claim 9, further comprises an infrared filter means placeable over said lamp for converting said visible light emission from said lamp to infrared emission and for preventing visible light emission from one said laser.

11. A low-profile illumination and laser sighting device for a weapon comprising:

a cylindrical housing having a longitudinal axis and a cross-sectional circular circumference, said housing is adapted for attachment to a weapon;

a circular receptacle attached at one end of said cylindrical housing, said receptacle having a larger circumference than the circumference of said housing and a central axis offset from the longitudinal axis of said cylindrical axis;

a single power supply coupled within said housing;

at least two lasers fixed to a support member adjustably coupled to the outside surface of said receptacle;

an illumination lamp coupled to said receptacle, said lamp having a reflector and an aperture placed through said reflector;

pressure switch means mounted on the outside of said housing for selectively controlling said lasers and said illumination lamp;

electrical conductors connected between said single power supply and said switch means; and a single lens attachable over said lamp and said lasers for simultaneously receiving emission from said lamp and at least one said laser.

12. The illumination and laser sighting device as recited in claim 11, further comprising a function switch means mounted on said receptacle for selectively coupling said power supply to said pressure switch means.

13. The illumination and laser sighting device as recited in claim 11, further comprising a function switch means mounted on said receptacle for selectively coupling said power supply to said lamp and at least one laser.

14. The illumination and laser sighting device as recited in claim 11, further comprising a function switch means mounted on said receptacle for selectively uncoupling said power supply from said lamp and said lasers.

15. The illumination and laser sighting device as recited in claim 11, further comprising a remote pressure switch mounted on said weapon for selectively controlling said lasers and said illumination lamp.

16. The illumination and laser sighting device as recited in claim 11, wherein said support member comprises:

a first support adjustment screw adjustably received at one location within said support member;

a second support adjustment screw adjustably received at another location within said support member; and a center pivot member partially received within said support member between said first and second adjustment screws, whereby said support member and attached lasers move about said pivot member during rotational movement of said first and second adjustment screws.

* * * * *